US007029351B1

(12) United States Patent
Reid et al.

(10) Patent No.: US 7,029,351 B1
(45) Date of Patent: Apr. 18, 2006

(54) BODY BOARD AND HANDLE FOR SAME

(76) Inventors: James C. Reid, 24601 Tarpon La., Orange Beach, AL (US) 36561; Roger Reid, 2920 Macalpine Cir., Birmingham, AL (US) 35242

( * ) Notice: Subject to any disclaimer, the term of this patent is extended or adjusted under 35 U.S.C. 154(b) by 0 days.

(21) Appl. No.: 10/999,657

(22) Filed: Nov. 30, 2004

(51) Int. Cl.
*B63B 35/79* (2006.01)

(52) U.S. Cl. ..... 441/74; 441/65

(58) Field of Classification Search ..... 441/65, 441/74, 75
See application file for complete search history.

(56) References Cited

U.S. PATENT DOCUMENTS 1,023,601 A 4/1912 Simpson
3,147,498 A * 9/1964 Convis ..... 441/65
4,439,165 A 3/1984 Rothstein
5,076,189 A * 12/1991 Jones ..... 114/253
5,472,362 A 12/1995 Dandurand
5,603,645 A 2/1997 Saccomanno
6,042,439 A 3/2000 Parten
6,306,000 B1 10/2001 Parten et al.
6,428,376 B1 8/2002 Reeder
6,544,089 B1 4/2003 Denegri

* cited by examiner

*Primary Examiner*—Jesus D. Sotelo
(74) *Attorney, Agent, or Firm*—C. Brandon Browning; Sirote & Permutt, P.C.

(57) ABSTRACT

A body board including a leash and leash connector assembly for attaching the leash to the board. A handle assembly is connected with the board utilizing solely the leash connector assembly. The handle assembly includes a base and a pair of arms extending outward therefrom in substantially opposite directions. An opening is provided through the base that is arranged to engage the leash connector assembly for connecting the handle assembly with the body board.

10 Claims, 4 Drawing Sheets

BODY BOARD AND HANDLE FOR SAME

FIELD OF THE INVENTION

This invention relates to an aquatic body board and more particularly to a body board having a handle assembly for providing additional control of the board when body surfing.

BACKGROUND OF THE INVENTION

Aquatic body boards are known in the prior art. Such boards generally include a substantially flat, rectangular buoyant member having a tapered front end, a top side for supporting a surfer's body and a bottom side for gliding across a surface of a wave. Many aquatic boards include a leash connected with and extending from the top side of the board for attaching to the wrist or ankle of the surfer. Aquatic body boards having a handle are also known in the art and are described, for example, in U.S. Pat. No. 1,023,601 to Simpson; U.S. Pat. No. 4,439,165 to Rothstein; U.S. Pat. No. 5,603,645 to Saccomanno; U.S. Pat. No. 6,428,376 B1 to Reeder and U.S. Pat. No. 6,544,089 to Denegri.

OBJECTS AND SUMMARY OF THE INVENTION

A primary object of the invention is to provide a body board having means for providing additional control of the board when body surfing.

A further primary object of the invention is to provide a body board having a handle.

A further primary object of the invention is to provide a handle for a body board.

A further primary object of the invention is to provide a body board having a leash and a handle.

A further primary object of the invention is to provide a handle that can be attached to a body board using a leash connector assembly.

A further primary object of the invention is to provide a body board that supplies a surfer an alternative to holding the sides of the board which can create drag causing a loss of speed and mobility of the board when body surfing.

A further primary object of the invention is to provide a body board having a handle for supplying a surfer means of creating leverage for preventing the front end of the board from descending when body surfing.

A further primary object of the invention is to provide a method of retrofitting a conventional body board with a handle.

Another object of the invention is to provide a body board having a handle for carrying the board.

The various objects of the invention are accomplished by providing a body board having a leash and a leash connector assembly for attaching the leash to the board. A handle assembly is connected with the board utilizing solely the leash connector assembly. Generally, the handle assembly includes a base for engaging the topside of the board and a pair of arms extending outward therefrom. Preferably, the handle is centrally arranged near the forward end of the board and includes molded grips conforming to a surfer's hands.

DETAILED DESCRIPTION OF PRESENTLY PREFERRED EMBODIMENTS

Figure 1:
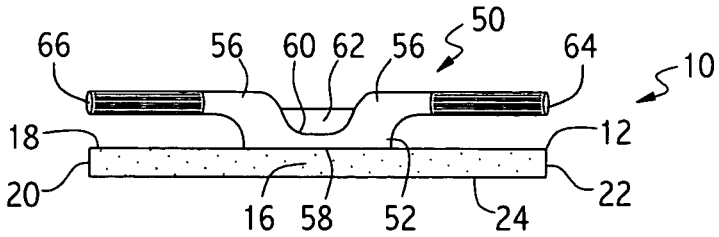
FIG. 1 is a rear elevational view of a body board in accordance with a preferred embodiment of the present invention.
Figure 2:
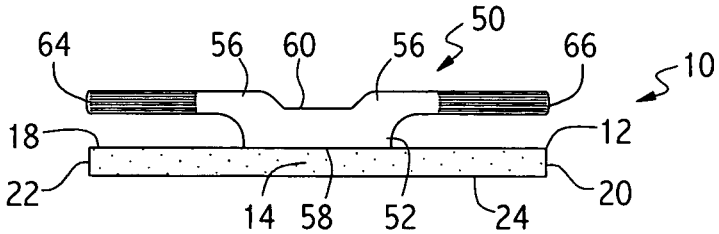
FIG. 2 is a front elevational view of the body board of FIG. 1.
Figure 3:
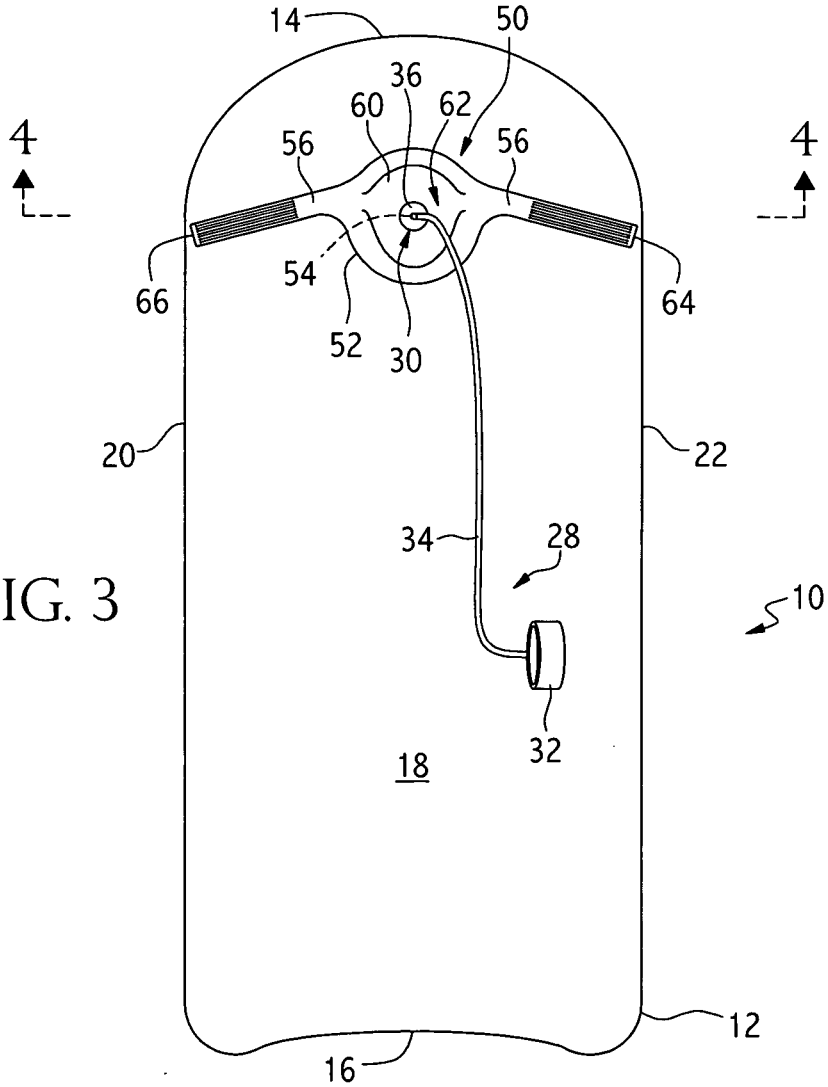
FIG. 3 is a top plan view of the body board of FIG. 1.
Figure 4:
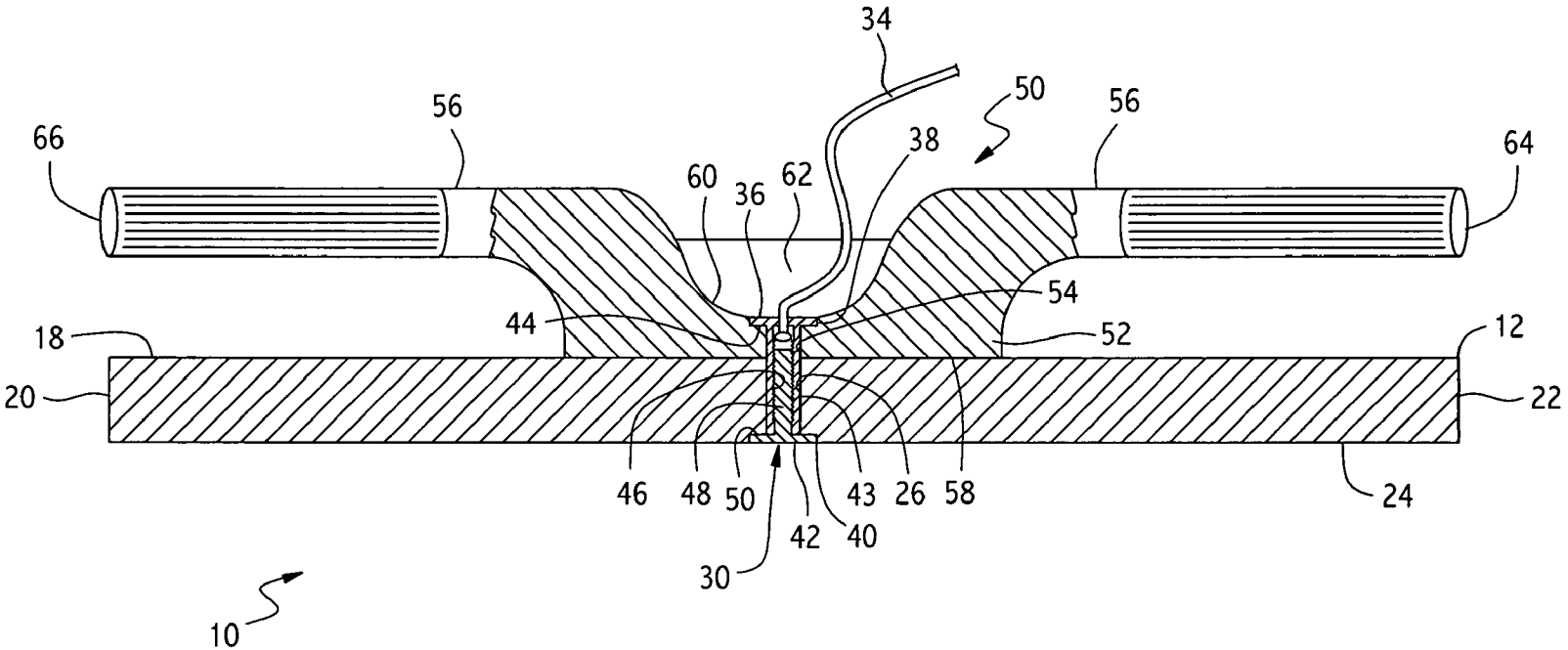
FIG. 4 is a sectional view of the body board of FIG. 3 along line 4—4.
Figure 5:
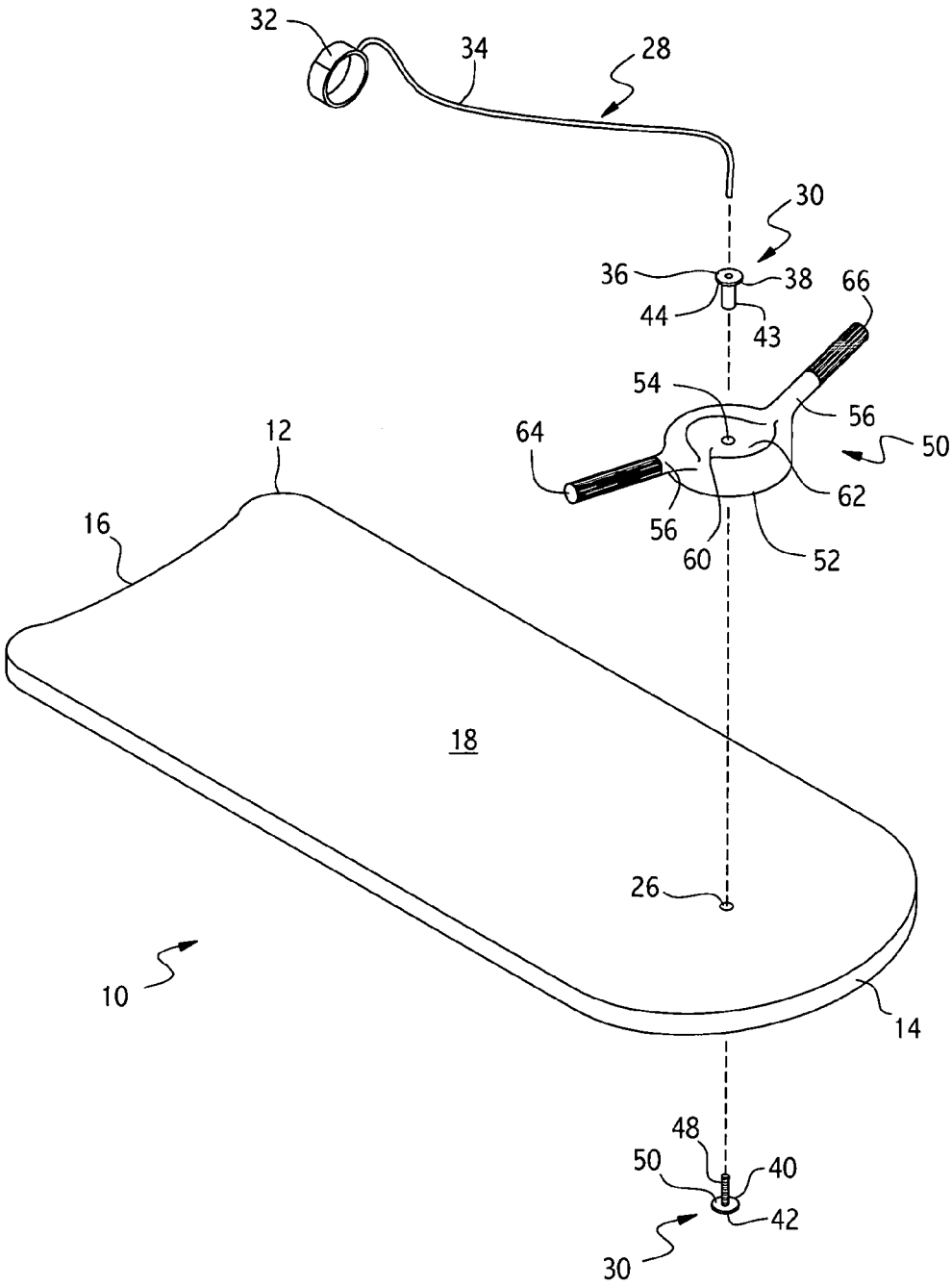
FIG. 5 is an exploded perspective view the body board of FIG. 1.
Figure 6:
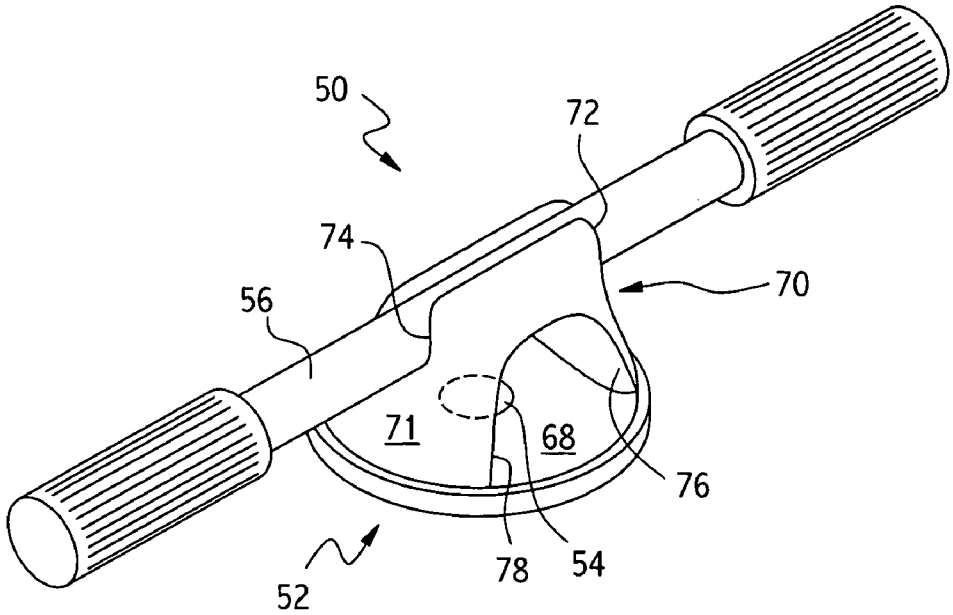
FIG. 6 is a front perspective view of a handle for a body board in accordance with another preferred embodiment of the present invention.
Figure 7:
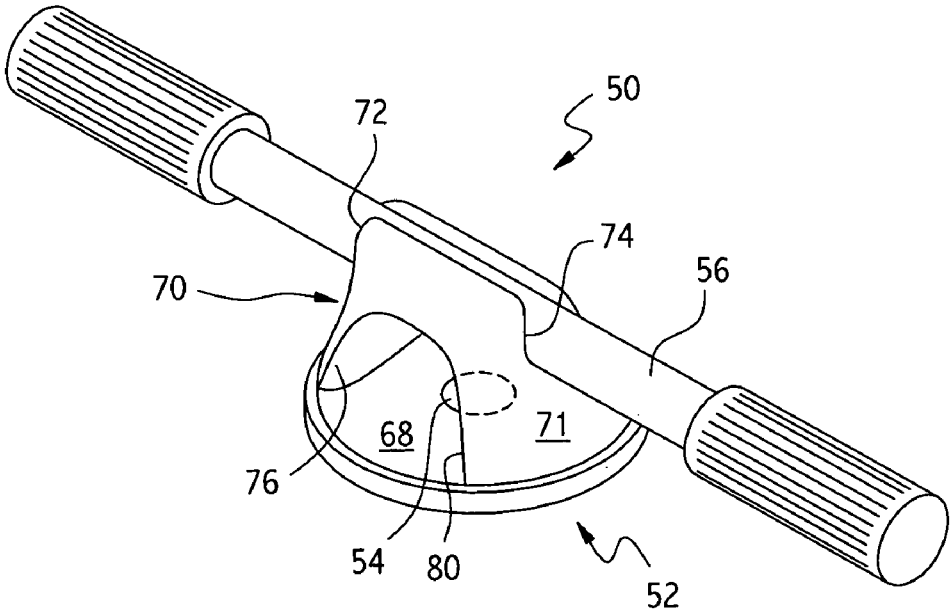
FIG. 7 is a rear perspective view of the handle of FIG. 6.

A body board and handle assembly are illustrated in FIGS. 1 through 5. An alternative handle assembly for the body board is illustrated in FIGS. 6 and 7, where like portions of the alternative handle assembly share like numbering with the handle assembly depicted in FIGS. 1 through 5. Turning to FIGS. 1 through 5 of the drawings, body board 10 comprises a bouyant, substantially planar body 12 having a rounded blunt forward end 14, a generally square rear end 16, a top side surface 18, an underside 24 and side edges 20 and 22, respectively. An opening 26 extends through planar body 12 near forward end 14 for connecting a leash 28 with planar body 12. Leash 28 includes an anchor 30 for anchoring leash 28 within planar body 12, a wrist or ankle band 32 for connecting leash 28 to a surfer's body and a tether 34 extending therebetween. Anchor 30 is comprised of two detachable pieces, including a top piece 36 that forms a first flange 38 and a bottom piece 40 that forms a second flange 42 for opposing first flange 38. Tether 34 attaches to and extends from first flange 38 of top piece 36.

Top piece 36 and bottom piece 40 are detachably connected through opening 26 of planar body 12. More particularly, top piece 36 includes an integral first arm 43 extending from a bottom surface 44 of first flange 38 and having a female threaded interior 46. Female threaded interior 46 is adapted to receive a male threaded arm 48 that extends from a top surface 50 of second flange 42. By inserting male threaded arm 48 into opening 26 from top side surface 18 and screwing arm 48 into female threaded interior 46, which is inserted into opening 26 from underside 24, first flange 38 and second flange 42 are drawn toward one another until contacting top side surface 18 and underside 24, respectively, of planar body 12. This way, leash 28 is securely connected with planar body 12.

In accordance with the present invention, a handle assembly 50 is connected with planar body 12 by utilizing only anchor 30 of leash 28. As described in more detail below, handle 50 includes a central base 52 having a hole 54 therethrough and a handlebar 56 supported by base 52. To connect handle assembly 50 with planar body 12, male threaded arm 48 of bottom piece 40 is unscrewed from female threaded interior 46 of top piece 36 so that first flange 38 and second flange 42 are pressed away from one another and top piece 36 and bottom piece 40 are detached. Top piece 38 of anchor 30 can then be withdrawn from opening 26 of planar body 12. With top piece 38 removed and opening 26 revealed, handle 50 is positioned above top side surface 18 with hole 54 being in alignment with opening 26. First arm 43 of first flange 38 is inserted through hole 54 and into opening 26 until first arm 43 comes into contact with male threaded arm 48. Male threaded arm 48 is screwed into female threaded interior 46 of first arm 43. By screwing male threaded arm 48 into female threaded interior 46, first flange 38 and second flange 42 are drawn toward one another to press base 52 of handle assembly 50 about hole 54 and against top side surface 18 of planar body 12. This way, anchor 30 and ultimately handle assembly 50 are securely connected with planar body 12.

In FIGS. 1 through 5, handle assembly 50 is shown with base 52 and handlebar 56 forming a unitary body, for example, a single plastic assembly. According to this embodiment, base 52 is a substantially circular, solid piece having a flat bottom side 58 for engaging top side surface 18 of planar body 12 and an opposing top side 60. Top side 60 includes a depression 62 that extends toward bottom side 58 and terminates in hole 54. Handlebar 56 is comprised of a right bar 64 and a left bar 66, with bars 64 and 66 being supported by and extending laterally from opposing sides of base 52. Handle assembly 50 is arranged to extend across planar body 12 with right bar 64 terminating about side edge 22 of planar body 12 and left bar 66 terminating about side edge 20.

Alternatively, in FIGS. 6 and 7, handle assembly 50 is shown with base 52 and handlebar 56 forming two distinct pieces. According to this embodiment, base 52 includes a circular flat plate 68 with hole 54 extending centrally therethrough and a handle support piece 70 supported by plate 68. Handle support piece 70 comprises a hollow, dome-shaped member 71 having an upper portion 72 forming a channel 74 for holding handlebar 56 and a lower portion 76 extending downward from upper portion 72 for connecting with plate 68. Handlebar 56 is seated within channel 74 with handlebar 56 having a length so that each end of handlebar 56 terminates about side edges 20 and 22, respectively, of planar body 12. A pair of opposing apertures 78 and 80 extend through opposing sides of dome-shaped member 71 for providing an access to hole 54 and an exit for leash 28 when handle assembly 50 is attached to planar body 12.

As will be apparent to one skilled in the art, various modifications can be made within the scope of the aforesaid description. Such modifications being within the ability of one skilled in the art form a part of the present invention and are embraced by the claims below.

It is claimed:

1. A body surfing apparatus comprising, a body board, a leash connector assembly for connecting a leash with the body board, and a handle assembly connected with body board, wherein the leash connector assembly connects the handle assembly with the body board, wherein the handle assembly includes a base portion and a left handle bar and a right handle bar extending out therefrom, wherein the base includes a central depression terminating in an opening wherein the opening is adapted to receive a top portion of the leash connector assembly and wherein the top portion of the leash connector assembly is connected with a leash.

2. A body surfing apparatus comprising, a body board, a leash connector assembly for connecting a leash with the body board, and a handle assembly connected with body board, wherein the leash connector assembly connects the handle assembly with the body board and wherein the handle assembly and a top portion of the leash connector assembly are integral.

3. A method for connecting a handle apparatus to a body board, the body board including a leash connector assembly for connecting a leash with the body board, the method comprising, disconnecting at least one portion of the leash connector assembly from the body board, engaging the at least one portion of the leash connector assembly with the handle apparatus, and reconnecting the at least one portion of the leash connector assembly with the body board.

4. The method according to claim 3 wherein the at least one portion of the leash connector assembly is connected with a leash.

5. The method according to claim 3 wherein the handle apparatus includes a base having a hole therein adapted to receive the at least one portion of the leash connector assembly.

6. The method according to claim 3 wherein the at least one portion of the leash connector assembly has a section having a width greater than a diameter of the hole in the base.

7. A body surfing apparatus comprising, a body board, a handle assembly including a base having a handlebar extending out therefrom and an opening centrally located through the base, and a flanged member detachably connected with the body board, the flanged member having a flange with a width greater than a width of the opening, wherein a portion of the flanged member extends through the opening and the flange engages with the handle assembly about the opening thereby connecting the handle assembly with a central, forward portion of an upper surface of the body board and wherein a leash is connected with the flanged member.

8. The apparatus according to claim 7 wherein the handlebar includes a first arm terminating about a first lateral side of the body board and a second arm terminating about a second lateral side of the body board.

9. The apparatus according to claim 8 wherein each of the first arm and the second arm supports a grip molded to conform to a user's hand.

10. A body surfing apparatus comprising, a body board, a handle assembly including a base having a handlebar extending out therefrom and an opening centrally located through the base, and a flanged member detachably connected with the body board, the flanged member having a flange with a width greater than a width of the opening, wherein a portion of the flanged member extends through the opening and the flange engages with the handle assembly about the opening thereby connecting the handle assembly with a central, forward portion of an upper surface of the body board and wherein the handle assembly is integral with the flanged member.

* * * * *